United States Patent [19]

Cox, Jr.

[11] 4,152,885

[45] May 8, 1979

[54] INTERLOCKED YARN AND METHOD OF MAKING SAME

[75] Inventor: Paul R. Cox, Jr., Cary, N.C.

[73] Assignee: Hercules Incorporated, Wilmington, Del.

[21] Appl. No.: 812,202

[22] Filed: Jul. 1, 1977

[51] Int. Cl.[2] ..... D02G 3/34; D02G 3/38

[52] U.S. Cl. ..... 57/207; 57/224; 57/227

[58] Field of Search ..... 57/140 R, 140 J, 144

[56] References Cited

U.S. PATENT DOCUMENTS

| | | | |
|---|---|---|---|
| 2,783,609 | 3/1957 | Breen | 57/140 |
| 2,852,906 | 9/1958 | Breen | 57/34 |
| 3,365,872 | 1/1968 | Field, Jr. | 57/144 |
| 3,473,315 | 10/1969 | LeNoir | 57/140 |
| 3,577,615 | 5/1971 | LeNoir | 28/271 |
| 3,678,549 | 7/1972 | Buzano | 28/271 |
| 3,732,684 | 5/1973 | Cook et al. | 57/144 X |
| 3,802,174 | 4/1974 | Landwehrkamp et al. | 57/140 J X |
| 3,824,776 | 7/1974 | London, Jr. | 57/140 J |
| 3,835,637 | 9/1974 | Russell | 57/144 X |
| 3,846,968 | 11/1974 | Sheehan et al. | 57/140 J |
| 3,857,230 | 12/1974 | Rasmussen | 57/140 J |
| 3,911,655 | 10/1975 | London, Jr. et al. | 57/140 J X |
| 3,946,548 | 3/1976 | Heno et al. | 57/140 J |
| 4,010,601 | 3/1977 | Anahara et al. | 57/160 |

FOREIGN PATENT DOCUMENTS

| | | | |
|---|---|---|---|
| 1029097 | 5/1966 | United Kingdom | 57/157 TS |

*Primary Examiner*—Charles Gorenstein
*Attorney, Agent, or Firm*—Joshua W. Martin, III; Stanley A. Becker

[57] ABSTRACT

An interlocked yarn having a plurality of continuous filaments which have substantially no twist and having at spaced intervals along the length thereof at least one of the filaments encircling the other filaments to interlock the filaments together. The method of making the interlocked yarn includes feeding a plurality of continuous filaments into a fluid jet which has a fluid medium passing therethrough in a direction substantially counter to the direction of travel of the filaments. The interlocked filaments are pulled away from the fluid jet at a rate less than the feed rate. This produces an interlocked yarn having some of the filaments encircling the other filaments to provide an interlock at spaced intervals which eliminates the need to twist the bundle of filaments.

5 Claims, 5 Drawing Figures

INTERLOCKED YARN AND METHOD OF MAKING SAME

BACKGROUND OF THE INVENTION

This invention relates to a novel interlocked yarn and a method for making interlocked yarn. More specifically, it relates to an interlocked yarn including a plurality of continuous filaments having substantially no twist with the filament bundle having at least one of the filaments encircling the other filaments at spaced intervals along the length thereof to interlock the filaments together. The yarn is firmly held together by the interlock, thus eliminating the need for twisting or cohesive materials to hold the bundles together during processing or use.

It has long been recognized that the yarns must be twisted before fabrication into goods. The twist is necessary to contain loose ends and broken or wild filaments, to overcome filament flaring because of static electricity build-up during processing, and to minimize slub formation in the drop wires and heddles of the loom during weaving. However, twisting is expensive and time consuming and reduces the effective coverage of the yarn. It has been proposed to eliminate the need for twisting by interlacing the yarn, however, interlacing also has many disadvantages. Interlacing sometimes involves a separate operation from bulking and texturing and therefore increases costs of manufacture. Further, interlacing can usually be pulled out by high strain conditions used in fabrication. Consequently, interlaced yarn may also require some twisting for good processability. Additionally, the distance between entanglements in interlacing generally varies. Typically, interlacing is designed to come out during finishing or dyeing operations to improve coverage. However, sometimes the entanglement releases prematurely, which results in difficulty to further process the yarn. If the entanglement fails to release in processing, coverage in the fabric is impaired. An example of an interlaced or entangled yarn is shown in U.S. Pat. No. 3,846,968. An example of a yarn which has some twist in addition to an interlacing is shown in U.S. Pat. No. 3,911,655.

SUMMARY OF THE INVENTION

The subject invention relates to a continuous filament yarn product having interlocks intermittently spaced along its length. The interlock is formed by one or more filaments of the fiber bundle encircling the bundle to hold it together. The filaments forming the interlock may or may not be the same filaments for all interlocks along the length of the yarn bundle. The interlocked yarn is produced by passing a plurality of continuous filaments having substantially no twist into a fluid jet. A fluid medium is passed through the fluid jet in a direction substantially counter to the direction of travel of the filaments to cause at least some of the filaments to encircle the bundle of filaments at spaced intervals along the length thereof. The interlocked bundle of filaments is pulled away from the fluid jet at a rate less than the feed rate.

The subject interlocked yarn has many advantages, among which include the fact that the interlock is permanent for the effective life of the yarn. It is usually necessary to break the wrapper to remove the interlock. Thus, there is little possibility of the yarn losing the interlock during processing or fabrication. Additionally, the need for twisting or interlacing is eliminated, thus reducing the effective cost of the yarn. Fabric coverage is very good and flaring filaments are controlled. Furthermore, strip backs due to broken filaments are stopped by the next interlock and will not cause major fabric defects or loom breakdowns. A strip back occurs where broken or loopy filaments (filaments which are longer than the average filament length within the fiber bundle) are snagged by elements in the processing equipment, e.g., the drop wires of a weaving loom, and continue to build up until the fabric becomes defective or the fabrication operation is halted. A further advantage is that interlocking and texturing or bulking can be accomplished in a single integrated operation, thereby further reducing cost. Also, the method of producing the interlocks permits forming interlocks at substantially equal spacing along the filament bundle. The interlocking stabilizes movement of the filaments in the completed fabric. Additionally, the interlocking method can be used to create novel effects in the fabrics when variable dyeable or pigmented yarns are used. By combining several ends of the yarn, the interlocking process can reduce color or dye streaks caused by end-to-end non-uniformity of the resulting yarns.

Other advantages of the present invention will be apparent from the following detailed description of the invention when considered in conjunction with the following detailed drawings. It is to be noted that the drawings illustrated only typical embodiments of the invention and are therefore not to be considered limiting of its scope, for the invention may admit to other equally effective embodiments.

DESCRIPTION OF THE INVENTION

Figure 1:
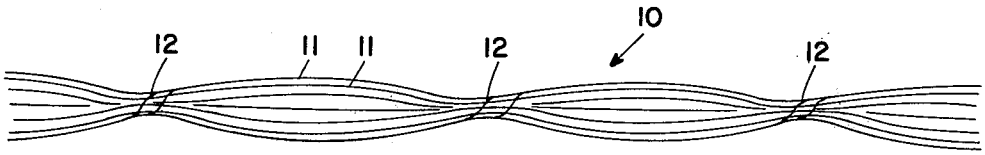
FIG. 1 is an enlarged view of a portion of an interlocked yarn in accordance with the principles of this invention.

Referring to FIG. 1, there is shown an enlarged view of an interlocked yarn generally designated as 10, having a plurality of continuous filaments 11 and having one or more of the filaments encircling the yarn bundle at substantially equal intervals to provide interlocks 12. The interlocks 12 hold the yarn bundle together without requiring twisting or cohesive materials to hold the continuous filaments 11 together. The interlocks 12 also stabilize movement of the filaments in the completed fabric.

Each interlock 12 may be formed by up to 20% of the filaments within the thread line leaving the fiber bundle and encircling or wrapping around the bundle a sufficient number of times as to tie or lock the bundle together. Preferably, the number of filaments making the interlock is 5% to 10% of the filaments in the yarn bundle. However, the operable number can be from 1% (one filament) to 20%. The filaments forming the interlock may fold or double up on themselves, although this is not necessary to form a good interlock. All of the yarn bundle need not necessarily be encircled by the interlocking filaments on any given interlock, however, enough filaments of the yarn bundle are bound together to secure bundle integrity. The distance the interlocks are spaced apart can be from less than ⅛ of an inch to three or more inches. The preferred distances are from ⅛ of an inch to 1½ inches, depending on the particular end use and denier of the thread line bundle. The denier per filament (d.p.f.) of the thread line can vary widely, but is usually from 1 to 20.

Figure 2:
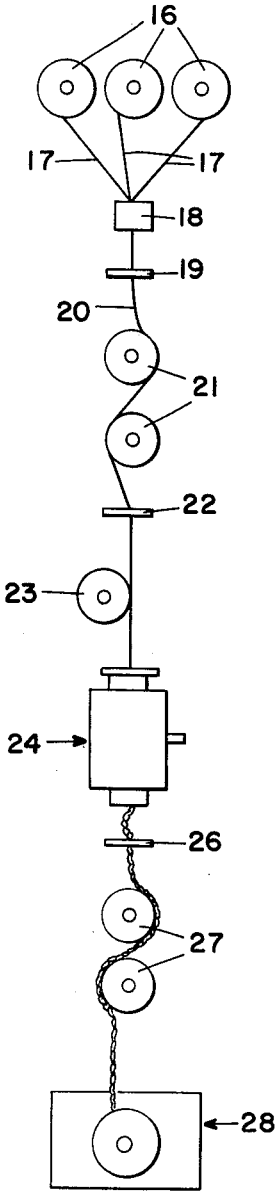
FIG. 2 is a schematic representation illustrating the apparatus and method of making interlocked yarn in accordance with the principles of this invention.

Referring to FIG. 2, there is shown apparatus for making the interlocked yarn 10 of FIG. 1. The apparatus includes a creel (not shown) on which a plurality of bobbins 16 (of which only three are shown) of continuous filament yarn are mounted. Thread lines 17 from each bobbin are passed through a tension device 18 to prevent excessive overfeed from the bobbins 16. The thread lines 17 may be combined in a thread guide 19 to form a yarn bundle 20 which is then passed through feed rolls 21. The yarn bundle 20 may pass through another stationary thread guide 22 and an undriven roller guide 23 into an interlocking jet 24 which is described more fully hereinafter. The interlocking jet 24 has a fluid medium passing therethrough in a direction substantially counter to the direction of movement of the yarn bundle 20 to cause interlocking to occur. The interlocked yarn bundle may pass through another stationary thread guide 26 upon exit from the interlocking jet 24 and then passes through a series of pullout rolls 27 which operate at a rotational speed less than the rotational speed of the feed rolls 21. The interlocked yarn bundle is then wound on a constant tension winder generally designated as 28.

The method of making the interlocked yarn 10 consists of feeding the yarn bundle 20 to the interlocking fluid jet 24 and then pulling the interlocked yarn away from the jet 24 at a speed less than the feed speed. The overfeed can be increased as desired to create more ballooning between interlocks. The fluid medium operating the interlocking jet 24 preferably is hot, as for example, steam, heated air, heated nitrogen, or mixtures of them. The interlock can be formed with room temperature air, however, the interlocks thus formed may have poor stability and are usually not spaced at uniform intervals. The interlocked yarn formed with room temperature air could be suitable for certain textile applications, but is usually less desirable than yarn made with hot fluid mediums. The yarn tension in the yarn bundle before it enters the interlocking jet 24 is always less than after it exits from the jet 24 because of the substantially counter directional fluid flow in jet 24.

Figure 3:
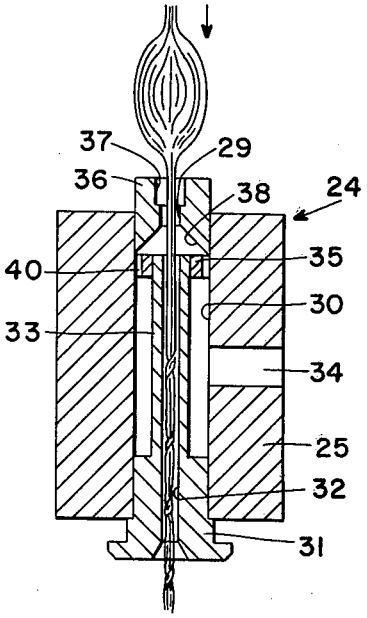
FIGS. 3 and 4 are cross-sectional views of two types of fluid jets than can be utilized in producing interlocked yarn in accordance with this invention.

Referring to FIG. 3, there is shown an interlocking jet generally designated as 24. The interlocking jet 24 includes a jet body 25 having a bore 30 therethrough. A yarn inlet member 36 is mounted within one end of the bore 30 in the jet body 25 and has a yarn passageway 29 therethrough including an enlarged inlet portion 37 and a tapered exit portion 38. A yarn exit member 31 is mounted in the other end of the bore 30 and has a yarn passageway 32 therethrough. A passageway 34 is provided in the body 25 to allow fluid, such as air or steam, to enter the jet body. The yarn exit member 31 has a portion 33 of reduced outside diameter to allow fluid to flow from the passageway 34 through yarn inlet passageway 29. An end section 35 of the exit member 31 is mounted about the reduced diameter portion 34 to center it and align the end of passageway 32 with passageway 29. The end section 35 has passageways or holes 40 therethrough to allow passage of the fluid. The primary flow of fluid through the jet body is in a direction counter to the direction of travel of the yarn bundle. The diameter of the entrance passageway 29 is equal to or larger than the diameter of the exit passageway 32. The length of the entry passageway 29 is preferably substantially shorter than the length of the exit passageway 32, e.g., 1 to 10. Passageways of equal length or passageways where the entrance is longer than the exit can be used but make a poorer quality interlocked yarn. In operation , the yarn bundle enters the inlet 29. Fluid flow introduced through passageway 34 passes through the jet body and out the inlet passageway 29. The interlock in the yarn bundle is made at or before the yarn bundle enters the interlocking jet 24 through passageway 29. It is believed that the movements and vibrations of the yarn bundle caused by the flow patterns of the fluids within the jet body 25 cause the interlocks to be formed upstream of the interlocking jet. If a heated fluid is used, heat within the jet body 25 heatsets the filaments which encircle the yarn bundle to improve their stability. This heatsetting, however, is not necessary.

After the interlocking, the yarn may be passed over an edge surface to spread out the filaments between the interlocking in order to provide a flatter yarn giving better coverage. Alternatively, the interlocked yarn can pass through a high velocity air stream to bloom and intermingle the filaments between interlocks . Additionally, the interlocked yarn could be passed over a sharp edge under high tension to cut some of the outer filaments between the interlocks. This provides the appearance of a spun yarn. If desired, such a yarn may be passed through a texturing jet so the cut ends will ball up to form a slubby or nubby yarn.

Figure 4:
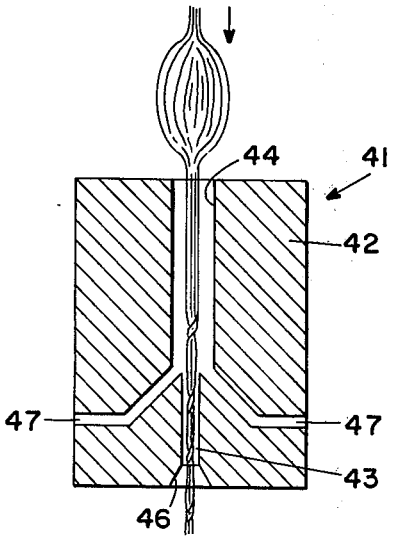

Referring to FIG. 4, an alternative embodiment of an interlocking jet generally designated as 41 is shown. The interlocking jet 41 includes a jet body 42 having a bore 43 formed therethrough. The passageway 43 has an enlarged diameter 44 at the entrance end and has an enlarged tapered end 16 at the exit end. Fluid entry is provided through passageways 47. The fluid moves out the entrance passageway 44 counter to the direction of travel of the yarn bundle.

It is believed that it is the action of the fluid medium within the jet body which causes one or more of the continuous filaments in the yarn bundle to encircle the yarn bundle at a point at or prior to the entrance to the interlocking jet.

Figure 5:
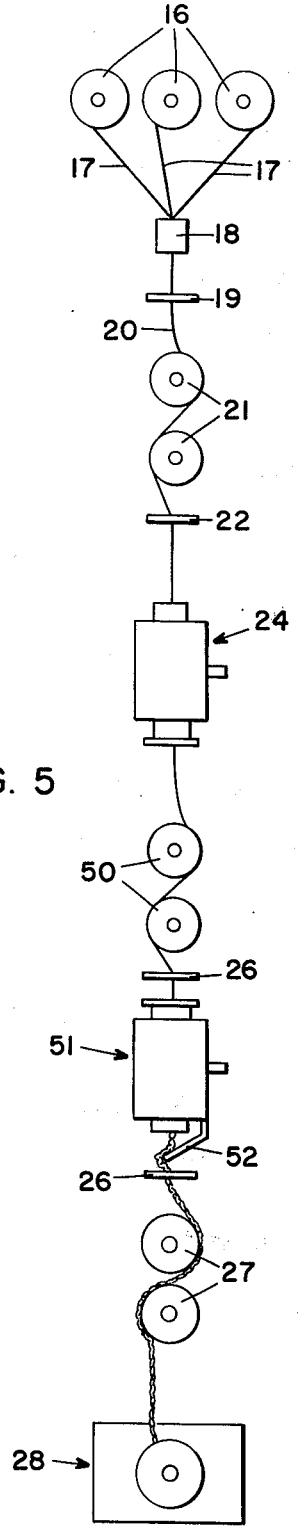
FIG. 5 is a schematic representation of a method for interlocking and texturizing yarns in a continuous integrated operation.

Referring now to FIG. 5, there is shown apparatus for interlocking and texturing yarns in a continuous integrated operation . The apparatus is basically the same as that shown in FIG. 2 and like numbers correspond to like parts in both Figures. The FIG. 5 apparatus, however, includes a texturing jet generally designated as 51 following the thread guide 26. The texturing jet 51 is preferably of the type disclosed in U.S. Pat. Nos. 3,457,611 and 3,471,911. The interlocked yarn passing through the texturing jet impacts against a screen 52 then passes through thread guide 26 and pullout rolls 27 onto a winder 28. Optional separator rolls 50 may also be used.

The interlocked yarn made in accordance with this invention is especially desirable in textile fabrications such as weaving, knitting and tufting. The yarn serves to eliminate the need for twist and/or interlacing. It also gives good coverage and runnability. Strip-backs and uncontrolled or flaring filaments are eliminated. Such a yarn can also be used in industrial fiber applications such as tire cord and electrical wire wrapping material . Twist in tire cord yarn reduces the tensile strength of the cord and inhibits its ability to adhere to latex. To properly insulate wire, the wrapping material requires that the filaments of the fiber bundle should be spread apart. However, the wrapping yarn should not flare excessively as to result in entanglement during processing. The interlocked textured yarns of this invention have spread filaments that are restricted from excessive flaring . Changes in latex, pick-up or tensile strength loss would be minimized using such filaments.

The principles of this invention are exemplified by the following examples, which are given to illustrate the invention and are not to be considered limiting in any way.

EXAMPLE 1

Using apparatus such as shown in FIG. 2, an interlocked yarn was prepared using three ends of drawn continuous filament polypropylene yarns, each having a denier of 1500±50 and 140 filaments. The three ribbons of yarn were loaded on a creel. Thread lines from each bobbin passed through a tensioning device to prevent excessive over-feed from each yarn package. All three thread lines were combined in a thread guide and the resulting yarn bundle was passed through feed rolls which had a rotational speed of 212 meters per minute. The thread line then passed through a stationary guide to an undriven roller guide and into an interlocking jet which was operated with 100 p.s.i.g. steam pressure. Interlocks were formed in the yarn about 1¼ inches apart just prior to the yarn entering the interlocking jet. Heat from the steam set, but did not fuse the interlocking filaments. It was observed that the thread line had opened to form a balloon of filaments just prior to entry into the interlocking jet. The downstream end of this balloon was located at the thread line entry into the jet while the upstream end of the balloon was about 1¼ inches upstream of the jet entry. From the interlocking jet the thread line went to the pull-out rolls which were operating at a rotational or feed speed of 195 meters per minute. The interlocked yarn was then wound on a constant tension winder at about 25 grams tension. The interlocking jet was set at an air flow rate of 6.8 s.c.f.m. The interlocking jet was similar to that shown in FIG. 3. The entry passageway had an orifice diameter of 0.103±0.002 inch and was 0.128 inch long. The exit passageway had an orifice diameter of 0.092±0.001 inch and was 2.3 inches long.

EXAMPLE 2

Using apparatus such as shown in FIG. 5, with the exception of the optional separator rolls 50 which were omitted, an interlocked and textured yarn was prepared from one end of 300 denier drawn continuous filament polypropylene yarn having 72 filaments . The yarn was passed through a feed roll at 149 meters per minute and into an interlocking jet which was operating with 110 p.s.i.g. steam pressure. The air flow to the interlocking jet was 1.5 s.c.f.m. Interlocks were formed in the yarn about 0.366 centimeter apart. The orifice diameter of the entry section of the interlocking jet was 0.073 inch and the length of the entrance passageway was 0.130 inch. The exit tube had a diameter of 0.040 inch and a tube length of 2.3 inches. The overall length of the interlocking jet was 2.625 inches. The thread line was fed from the interlocking jet through a texturing jet where the filaments between the interlocks were textured and passed on to the pull-out rolls. The texturing jet was operated with 100 p.s.i.g. steam pressure, and had an air flow of 11.3 s.c.f.m. The interlocked textured yarn was then wound on a constant tension winder. This yarn was made into a 44 sley warp and woven into crow foot weave pattern fabric having 30 picks per inch. Weaving performance was excellent.

What I claim and desire to protect by Letters Patent is:

1. An interlocked yarn comprising:

a plurality of continuous filaments having substantially no twist and having at spaced intervals along the length thereof at least one continuous filament of said plurality encircling most of said other filaments to interlock said filaments together, said encircling obtained by passing said filaments through a fluid jet and passing a fluid medium through said jet in a direction substantially counter to the direction of travel of said filaments and by pulling the filaments away from said jet at a rate less than the rate at which the filaments enter said jet.

2. An interlocked yarn as set forth in claim 1 wherein said filaments are textured.

3. An interlocked yarn as set forth in claim 1 wherein said filaments between interlocks are substantially flattened and spread out.

4. An interlocked yarn as set forth in claim 1 wherein said filaments are polypropylene.

5. An interlocked yarn as set forth in claim 1 wherein some of the outer filaments between interlocks are cut.

* * * * *